United States Patent [19]

Piur

[11] 4,319,076

[45] Mar. 9, 1982

[54] ELECTRICALLY INSULATIVE HOLLOW-PROFILE STRUCTURAL PART WITH HIGH-TENSION ATTACHING ELEMENTS AND METHOD OF CONSTRUCTING SAME

[75] Inventor: Armin Piur, Spreitenbach, Switzerland

[73] Assignee: Micafil Aktiengesellschaft, Zurich, Switzerland

[21] Appl. No.: 72,623

[22] Filed: Sep. 5, 1979

[51] Int. Cl.[3] ..... H01B 17/00

[52] U.S. Cl. ..... 174/178; 29/631; 285/55; 285/332; 285/423

[58] Field of Search ..... 174/DIG. 1, 68 C, 84 S, 174/138 R, 138 D, 176, 177, 178, 179; 138/109, DIG. 2; 285/55, 149, 332, 332.1, 423, DIG. 16, DIG. 20, DIG. 24; 29/631

[56] References Cited

U.S. PATENT DOCUMENTS 3,268,240 8/1966 Gerner ..... 285/55

4,014,568 3/1977 Carter et al. ..... 285/DIG. 16 X

FOREIGN PATENT DOCUMENTS 1276445 10/1961 France ..... 174/176

*Primary Examiner*—Laramie E. Askin

*Attorney, Agent, or Firm*—Burns, Doane, Swecker & Mathis

[57] ABSTRACT

An electrically nonconducting hollow-profile structural part having a protective cover, preferably made of polyester threads or fibers, with a mechanically supporting glass-reinforced plastic core, especially for $SF_6$ insulating gas technology. The hollow-profile structural part has an end that is conically shaped and connected to an attaching element with an oppositely facing conical surface by means of conically-constructed screw and/or cemented connections in such a way that the glass-fiber interfaces of the core exposed at the end surface are covered gastight by the cone superficies of the attaching element. As a result, the $SF_6$ insulation gas products of separation which attack glass and which develop as a result of corona discharges cannot come into contact with the glass fibers.

13 Claims, 2 Drawing Figures

ELECTRICALLY INSULATIVE HOLLOW-PROFILE STRUCTURAL PART WITH HIGH-TENSION ATTACHING ELEMENTS AND METHOD OF CONSTRUCTING SAME

BACKGROUND OF THE INVENTION

The invention relates to electrically nonconducting hollow-profile structures, especially for $SF_6$ insulated apparatuses and installations in high-tension and extra-high-tension ranges wherein the structure includes a glass-containing insulative component such as a glass reinforced plastic (GRP) core, and to whose ends attaching elements are fastened, and also to a method for protecting the glass-containing insulative component from the products of separation of the $SF_6$ gas.

$SF_6$ insulating gas is employed for insulation in high-tension (high voltage) and extra-high-tension applications such as in bushings for high voltage transformers operating in the 125 KV, 500 KV or higher voltage ranges. The use of electrically-insulating structural parts made of layered molded plastics built up out of plastic-impregnated polyester fibers for protection against agressive products of separation of the $SF_6$ insulation gas, which attach glass, is already known.

In this connection, one disadvantage consists of the fact that in layered molded plastics of this sort, built up without any glass component, the polyester fibers have less interlaminar resistance to flexing, a lower E modulus, a lower thermal carrying capacity and generally worse mechanical characteristics than do the glass fibers. Therefore, it has already been suggested that such electrically non-conducting, hollow-profile structural parts as consist of a stress-receiving GRP core and a fiber/GRP/fiber/fiber casing or envelope be produced by a sandwich or layer construction method.

This latter arrangement has the disadvantage that the glass fiber interfaces of the GRP layered molded plastic come into contact, on the front sides of the profile structural part, with the formations of gas resulting from carona discharges in the $SF_6$ insulation gas (i.e. products of separation of the $SF_6$ gas), in which hydrogen fluoride (HF), with moisture (condensate) which possibly may be present, can change into hydrofluoric acid, which attacks the glass components and causes quartz to be released.

Another important disadvantage is to be found in the fact that glass fiber interfaces are exposed by the threading process on the surface of the ends of the profile structural part when there is a threaded or "screw" connection between the profile structural part and the attachment fitting. These exposed glass fiber interfaces can come into contact with the glass-disintegrating products of separation of the $SF_6$ insulation gas.

In order to protect the glass fibers against products of separation of the $SF_6$ insulation gas, it has been suggested that the exposed glass fiber interfaces be coated with a layer of lacquer or varnish. However, a relatively thin layer of such materials does not give the required protection, for the $SF_6$ insulation gas products of separation can reach the GRP core of the profile structural part by diffusion and attack the glass component, destroying the insulating structural part in that way.

OBJECTS AND BRIEF SUMMARY OF THE INVENTION

The primary object of the invention is to provide an effective arrangement which will guarantee a reliable and permanently effective protection of the glass component, and especially of the glass fiber interfaces, against the $SF_6$ insulation gas products of separation.

The above-mentioned object is achieved in accordance with the invention by providing the surfaces of the GRP core with a protective cover to form the hollow-profile insulative structure and making the ends of the hollow-profile structure conical, with conically-constructed attaching elements being located on them in such a way that the conical sectional areas of the GRP core are covered gastight by the attaching elements and are tensionally connected by them.

By means of the arrangement of the invention and the connection of the ends of the hollow-profile part with the attaching elements in accordance with the invention, a gastight covering of the glass fiber interfaces of the GRP core against the $SF_6$ products of separation which attack glass is guaranteed, and thus a preliminary insulation in the $SF_6$ insulation gas technology is provided.

It is desirable for the protective cover to be made up of an outer and inner cover and for it to consist of silicon-free threads or fibers and preferably polyester threads.

It is also desirable for the protective cover to consist of plastic-impregnated, layer-wound polyester individual endless threads, overlapped, strip-wound and/or web-wound or tape-wound polyester fiber flat-shaped articles, preferably of textile, fabric or nonwovens.

It is recommended that the outer and inner covers of the hollow-profile structural part be provided by casting-resin protective covers or that the GRP core be enclosed in a casting-resin protective cover.

It is especially advantageous if the tensionally-connected connection is formed by a cemented bond.

In a preferred embodiment, such tensionally-connected connection can be a threaded or "screw" connection, with the threads of the screw connection of the insulative structure and attachment fitting being respectively outer and inner threads or inner and outer threads.

In accordance with this preferred embodiment of the invention, conical, stress-transmitting screw connections can also be used advantageously, with the glass fiber interfaces of the GRP core, exposed by the threading processes at the ends of the hollow-profile structural part, being covered in a gastight fashion.

By means of the conical screw connection of the invention between the ends of the hollow-profile structural part and the attaching elements, a more uniform stress over the entire cross section of the hollow-profile wall, and preferably the tube wall, is achieved by comparison with the standard cylindrical screw connections, and as a result a better introduction of stress into the GRP hollow-profile structural part is made possible.

In conformity with another arrangement, a cement can be added to the screw connection between the connecting surfaces.

It is also advantageous for a thrust ring to be located on the end of the hollow-profile structural part, and, in addition, it can be cemented to the hollow-profile structural part.

BRIEF DESCRIPTION OF THE DRAWINGS

In the drawings, embodiments of a hollow-profile structural part according to the invention are represented in simplified fashion.

DETAILED DESCRIPTION

Figure 1:
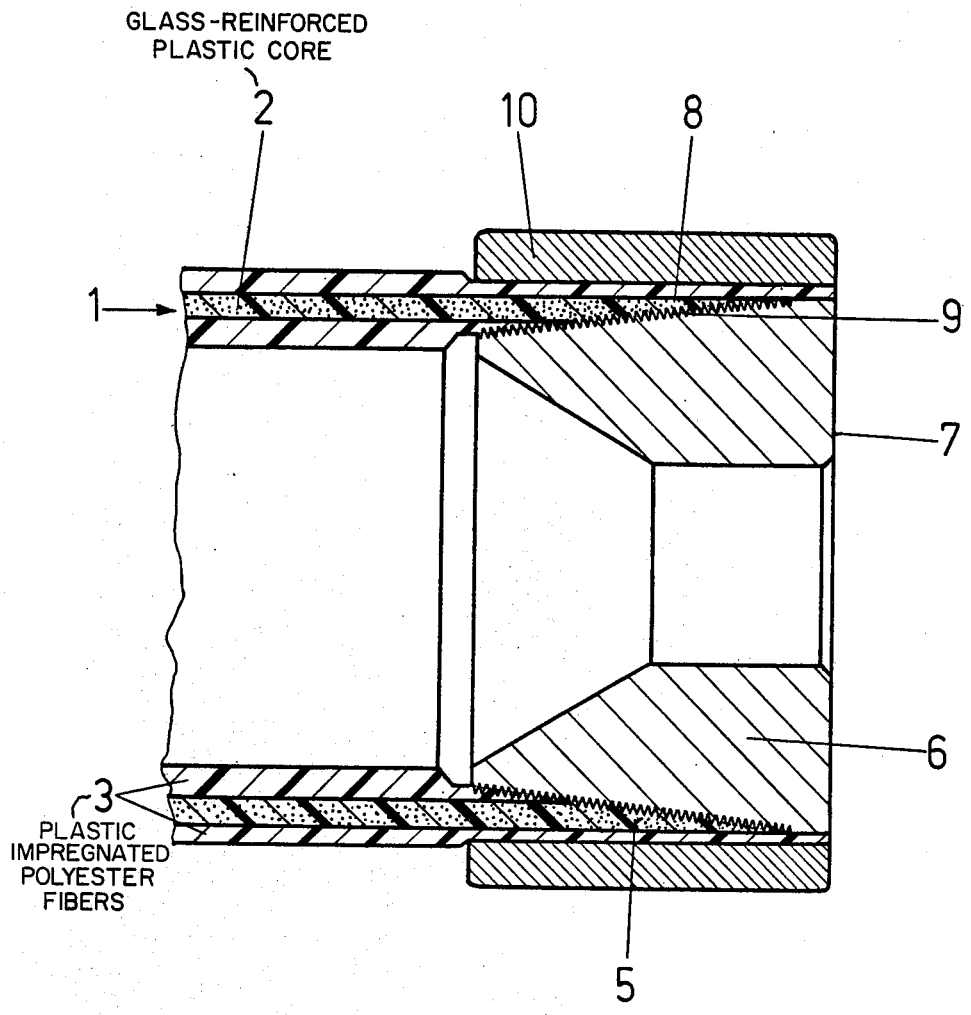
FIG. 1 is a partial longitudinal section through a threaded or screw connection made in accordance with the invention; and, FIG. 2 is a partial longitudinal section through a cemented connection, in accordance with the invention.
Figure 2:
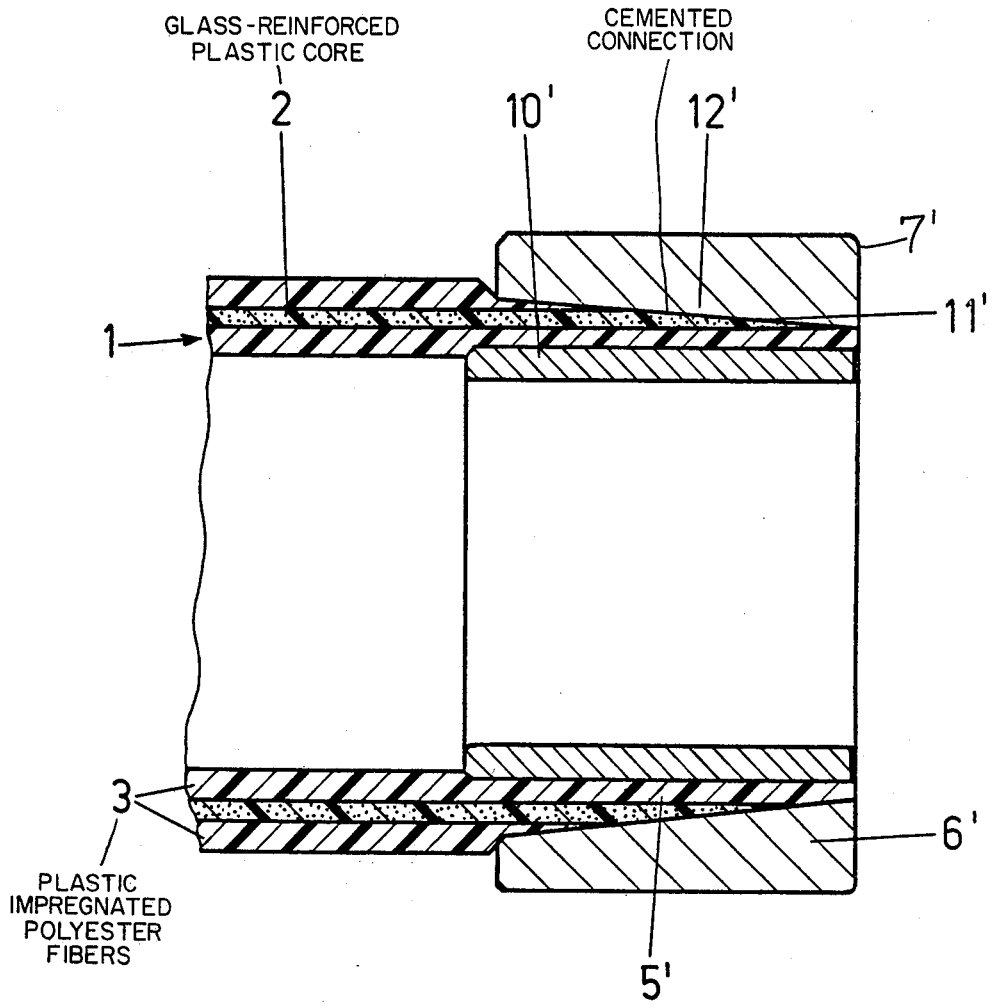

In FIGS. 1 and 2, a hollow-profile structural part 1 comprises a mechanically-supporting glass reinforced plastic (GRP) core 2 whose inner and outer surfaces are covered with a protective cover 3, preferably made of plastic-impregnated polyester fibers. In the drawing, only one end of the hollow-profile structural part 1 is shown.

In FIG. 1, the GRP core, hollow-profile structural part 1 has a screw connection, 8, 9 at its end—constructed as a reducer, for example—in which a conical inner thread 8 is connected tensionally with an outer thread 9 of a "countercone" 6 of an attaching element 7, so that the inner conical surface of the structure 1 and the oppositely facing (countercone) surface of the attaching element 7 are screwed together in gas tight relation. The attaching element 7 is made of metal, for example.

The thread shape selected is such that forces in the direction of the circumference which occur can be converted, in part, into compressive forces. Preferably, round threads, which engender a rather small notch effect, are used, and as a result a good introduction of stress into the mechanically weaker polyester material is guaranteed. In addition, a suitable cement can be applied to the surfaces of the screw connection 8, 9 as between the thread 8 of the hollow-profile structural part 1 and the mating thread 9 of the attaching element 7.

According to the invention, the interlocking conical surfaces 5, 6 are so arranged that the glass fiber interfaces on the surface of the end of the hollow-profile structural part 1 exposed by cutting the thread 8 are covered gastight by the superficies of the mating thread 9 of the countercone 6 of the attaching element 7, so that the products of separation of the $SF_6$ insulation gas which develop during corona discharges and which attack glass, cannot attack the glass component of the GRP core, and as a result a permanently effective electrical insulation in the $SF_6$ insulation gas technology is ensured.

In FIG. 2, the hollow-profile structural part 1 is constructed as a conically tapering outer cone 5' which is inserted into an inner cone 6' of the attaching element 7'. The tensionally-connected connection between the oppositely facing conical superficies 11', 12' is produced by a cemented connection, and as a result the exposed glass-fiber interfaces on the superficies 11' of the concially-constructed end of the hollow-profile structural part 1 are once again covered gastight against the outer atmosphere by the superficies 12' of the countercone 6' of the attaching element 7'. In addition, the conical construction 11' of the hollow-profile structural part 1 results in making the cemented surface many times larger by comparison with vertical front sides.

In both embodiments, the protective cover 3 on the inner and outer superficies of the GRP core 2, which consists of silicon-free threads or fibers, must have a wall thickness of at least approximately 1 mm. By this means, the danger of diffusion of the $SF_6$ insulating gas products of separation which attack glass is avoided up to the GRP core layer, since the protective cover 3, preferably made of polyester fibers, is so thick that gas diffusion is practically controllable.

In the case of the interlocking conical surfaces 5, 6, with screw connection, in FIG. 1, and 5', 6', with a cemented connection, in FIG. 2, the tapering of the conical surfaces may vary as a function of the total profile and the GRP core diameters. The protective cover 3 can consist of plastic-impregnated, layer-wound, individual endless threads, overlapped, band-wound (or strip-wound) and/or web-wound flat-shaped articles, preferably of textile fabric, nonwovens, or something of a similar sort, and polyester fibers can be used advantageously. The protective cover 3 could also be manufactured in such a way that the GRP core 2 is embedded in a casting resin, in which case either only the two longitudinal surfaces or a complete enclosing of the GRP core takes place. The embodiment in FIG. 1 could have only a cemented connection as in FIG. 2 instead of a screw connection 8, 9 and the embodiment of FIG. 2 could have a screw connection as in FIG. 1 instead of the cemented connection 11', 12'.

Especially in the case of thin wall thicknesses of the hollow-profile structural part 1, it is advantageous, in addition, to provide a thrust ring 10, 10' which is located outside, according to FIG. 1, and inside the end of the hollow-profile structural part according to FIG. 2. The thrust ring 10, 10' can also be cemented to the hollow-profile structural part. In the case of profiles which are more difficult geometrically, additional packing rings resistant to $SF_6$ (not shown) could be located on both edges of the attaching element 7, 7', opposite the GRP core 2.

The object of the invention is not limited to the examples of the hollow-profile structural part which have been given, such as switching tubes, chambers, pin-type insulators, and the like. Thus, in a large part of the entire $SF_6$ structural-part program, such as shifter rods, connecting elements, and the like, which also have GRP core layers provided with protective covers, the glass-fiber interfaces of the GRP core could be covered gastight against the outer atmosphere at various points of connection by similar, conically constructed screw and/or cemented connections.

The presently disclosed embodiments are therefore to be considered in all respects as illustrative and not restrictive. The scope of the invention is indicated by the appended claims rather than the foregoing description, and all changes which come within the meaning and range of equivalency of the claims are intended to be embraced therein.

What is claimed is:

1. An electrically insulative hollow-profile structural part having ends with high-tension attaching elements fastened thereto, for use in $SF_6$ insulating gas environments, comprising:

a hollow glass-reinforced plastic core;

a protective cover which is resistant to separation products of $SF_6$ insulating gas disposed over the surfaces of said hollow glass-reinforced plastic core that would be contacted by $SF_6$ insulating gas in the absence of the protective cover, each end of the covered core having a conical surface formed in part by said hollow glass-reinforced plastic core and in part by said protective cover; and, high-tension attaching elements, for each of said ends, with conical surfaces facing opposite the conical surfaces on the ends of the covered core, the high-tension attaching elements being disposed on the conical surfaces on the ends of the covered core in such a way that the conical surfaces on the ends of said covered core are covered gastight by the conical surfaces of the high-tension attaching elements and are tensionally connected thereto.

2. The device as claimed in claim 1, characterized in that the protective cover is formed by an inner and an outer covering of the hollow glass-reinforced plastic core.

3. The device as claimed in claims 1 or 2, characterized in that the protective cover comprises silicon-free fibers of polyester.

4. The device as claimed in claims 1 or 2, characterized in that the protective cover comprises plastic-impregnated, layer-wound polyester individual endless threads.

5. The device as claimed in claim 2, characterized in that the outer and inner coverings are constituted by a casting-resin protective cover.

6. The device as claimed in claims 1 or 2, characterized in that said protective cover is a casting-resin protective cover enclosing said hollow glass-reinforced plastic core.

7. The device as claimed in claim 1, characterized in that the tensionally-connected connections are formed by cemented bonds along the conical surfaces of the ends of the covered core and the high-tension attaching elements.

8. The device as claimed in claim 1, characterized in that the tensionally-connected connections are screw connections along the conical surfaces of the ends of the covered core and the high-tensions attaching elements.

9. The device as claimed in claim 8, characterized in that each screw connection includes a thread and mating thread made as outer and inner threads.

10. The device as claimed in claims 8 or 9, characterized in that, in addition to the screw connections, a cement is provided between the superficies of the screw connections.

11. The device as claimed in claims 1, 7, 8 or 9, including a thrust ring disposed at each end of the covered core such that each end of the covered core is interposed between a thrust ring and a high-tension attaching element.

12. The device as claimed in claim 11, characterized in that each thrust ring is cemented to the covered core.

13. A method of constructing an electrically insulative, hollow-profile structural part having an end with a high-tension attaching element fastened thereto, for use in $SF_6$ insulating gas environments, comprising the steps of:

forming a hollow glass-reinforced plastic core with at least one end face;

covering surfaces of the hollow glass-reinforced plastic core to be exposed to $SF_6$ insulating gas during use with a protective cover of an electrically insulative material which is resistant to separation products of $SF_6$ insulating gas, said protective cover being applied to said hollow glass-reinforced plastic core in such a manner as to leave said end face of said hollow glass-reinforced plastic core exposed;

shaping the end of the covered core so as to provide a conical surface extending across the hollow glass-reinforced plastic core and the protective cover and thereby increase the surface area of exposure of said hollow glass-reinforced plastic core and said protective cover; and securing a high-tension attaching element having a conical surface facing oppositely to the conical surface of the covered core to the conical surface of the covered core with a gas-tight connection between said conical surfaces.

* * * * *